United States Patent [19]

Lamarre

[11] 4,081,881

[45] Apr. 4, 1978

[54] FOLDING CLOSURE

[75] Inventor: Cerge Rudolf Maxime Lamarre, Pointe Claire, Canada

[73] Assignee: R. Labelle, Brossard, Canada

[21] Appl. No.: 704,411

[22] Filed: Jul. 12, 1976

[30] Foreign Application Priority Data

Jan. 22, 1976 Canada ..... 244067

[51] Int. Cl.[2] ..... E05D 3/04

[52] U.S. Cl. ..... 16/162

[58] Field of Search ..... 16/162, 135, 137, 128 A, 16/171, 172; 49/384, 397; 160/135, 351, 183, 229, 199, 206

[56] References Cited

U.S. PATENT DOCUMENTS

| | | | |
|---|---|---|---|
| 220,965 | 10/1879 | Decombe | 16/162 |
| 2,886,830 | 5/1959 | Iaquinta | 16/162 X |

*Primary Examiner*—Doris L. Troutman

[57] ABSTRACT

Improved hinge members, and hinges employing the improved hinge members, particularly in folding panel closures. Each hinge member has an elongated main body, and an opening in the main body for receiving a hinge pin. Each hinge member also has a facing wall spaced from, and substantially parallel to, the main body. The facing wall is joined to the main body by a radial extending web. A plurality of the hinge members are arranged end to end in a straight row, with the facing members abutting, in forming a hinge between two panels. The panels are joined to the web of the hinge members.

9 Claims, 7 Drawing Figures

FOLDING CLOSURE

BACKGROUND OF THE INVENTION

1. Field of the Invention

This invention is directed toward improved hinge members, and to hinges employing the improved hinge members.

The hinges of the present invention are particularly adapted to be used in folding closures and the invention is therefore also directed toward folding closures employing the improved hinge members.

2. Description of the Prior Art

Folding closures are normally used to close openings when space limitations do not permit the use of swinging closures. The folding closures generally comprise a plurality of panels, arranged serially, and with adjacent panels hinged together at their adjacent edges. When the opening is open, the folding closure is usually folded up along one side of the opening. In folded position, the hinged panels are zig-zagged together to lie nearly parallel, and closely adjacent, one another. When the opening is to be closed, the panels are unfolded about their hinges to extend across the opening from one side to the other, the panels lying in a very shallow zig-zag line.

It is desirable in many cases to have the closure close the opening without permitting viewing through the closure. To this end, the closure must avoid gaps at the areas where the hinges join the panels together. It is therefore a purpose of the present invention to provide a folding closure which avoids gaps at the hinges joining the panels when the folding closure is extended. It is another purpose of the present invention to provide a closure having hinges which are simple, inexpensive, and easily assembled to the panels. It is a further purpose of the present invention to provide hinges which give the closure a neat, clean appearance. It is a still further purpose of the invention to provide a single, simple hinge member, a plurality of which, together with a hinge pin, provide hinges, and closures having the above desired characteristics.

SUMMARY OF THE INVENTION

The invention, in one embodiment, is particularly directed to a hinge member having an elongated main body with a longitudinal opening for receiving a hinge pin. An elongated facing wall is spaced from, and substantially parallel to, the main body. A web extends radially from the main body to the longitudinal center of the wall to connect the wall to the main body.

Panel connecting means are preferably provided on one side of the web.

The web preferably tapers from a side end adjacent the facing wall to a narrow end adjacent the main body.

The invention is also particularly directed toward a hinge comprising a plurality of identical, elongated hinge members arranged end to end in a straight row, with each hinge member having an elongated main body and a longitudinal opening in the main body. The openings of the row of hinge members are aligned, and a hinge pin is mounted in the aligned openings to connect the hinge members together. Each hinge member has an elongated facing wall spaced from the main body. A web extends radially from the main body to the center of the wall to connect the wall to the main body. Each member has panel connecting means on one side of the web. The members are however arranged in the row to have the panel connecting means of some of the members in the hinge on one side of the webs and to have the panel connecting means of the other members in the hinge on the other side of the webs.

The web of each hinge member preferably tapers from a wide end adjacent the facing wall to a narrow end adjacent the main body.

The invention is further particularly directed toward a folding closure comprising a plurality of quadrangular panels arranged serially, and hinges pivotably connecting the adjacent edges of adjacent panels together. Each hinge comprises a plurality of identical, elongated hinge members arranged end to end in a straight row. Each member has an elongated main body with a longitudinal opening in the main body. The openings in each hinge are aligned, and a hinge pin is mounted in the aligned openings to connect the hinge members together. Every one hinge has its hinge pin on one side of the closure and every other hinge has its hinge pin on the other side of the closure.

Each hinge member in each hinge has an elongated facing wall spaced from the main body. A web extends radially from the main body to the center of the wall to connect the wall to the main body. Each member has panel connecting means on one side of the web. The members in each hinge are arranged to have the panel connecting means of some of the members in the hinge on one side of the webs and to have the panel connecting means of the other members in the hinge on the other side of the webs.

BRIEF DESCRIPTION OF THE DRAWINGS

The invention will now be described in detail having reference to the accompanying drawings in which.

DESCRIPTION OF THE PREFERRED EMBODIMENTS

Figure 1:
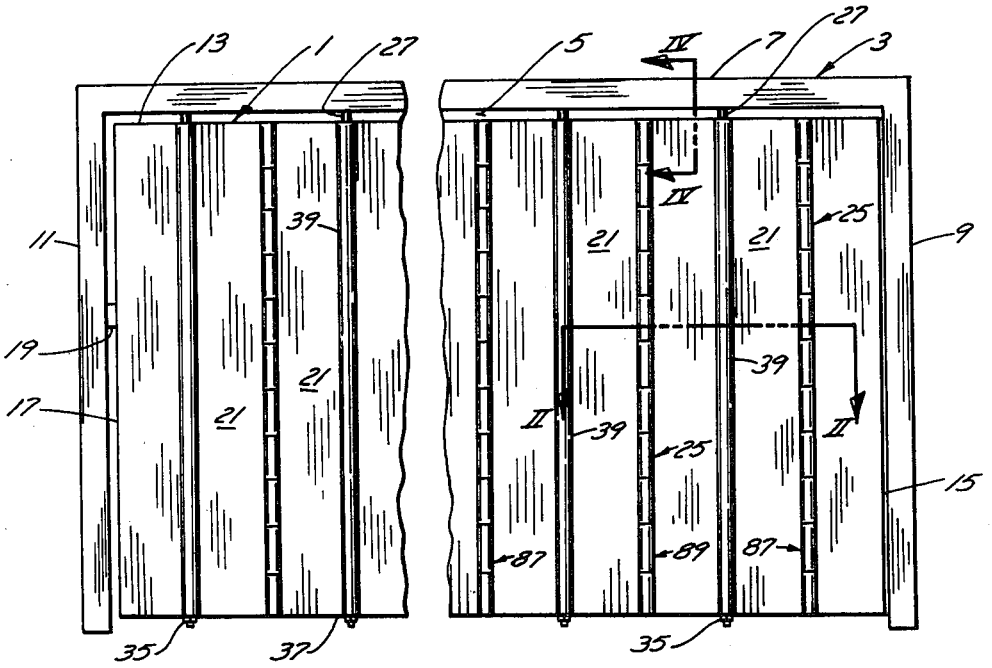
FIG. 1 is a partial front view of a folding closure according to the present invention.

The folding closure 1 of the present invention, as shown in FIG. 1, is mounted from a frame 3 defining an opening 5. The frame 3 has a top, horizontal frame member 7, and vertical end frame members 9, 11. The closure 1 is usually mounted in the opening 5, suspended by its top edge 13 from the top frame member 7, and with one side edge 15 pivotably fixed by suitable means to one end frame member 9. When the closure 1 is extended to close opening 5, its other side edge 17 reaches to other end frame member 11. When the closure 1 is folded to open opening 5, it lies adjacent the one end frame 9. Suitable lock means 19 can be provided to lock the closure to frame member 11 when opening 5 is closed.

Figure 4:
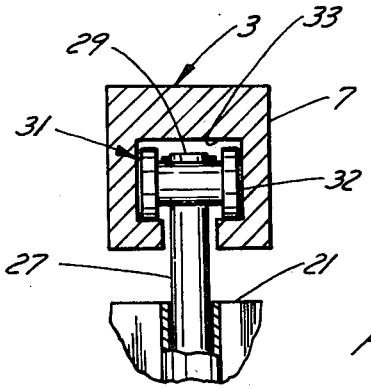
FIG. 4 is a cross-sectional view along line IV—IV of FIG. 1.
Figure 3:
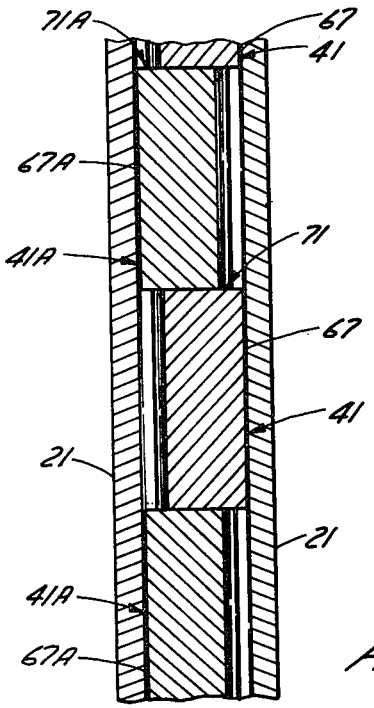
FIG. 3 is a partial cross-sectional view taken along line III—III of FIG. 2.
Figure 5:
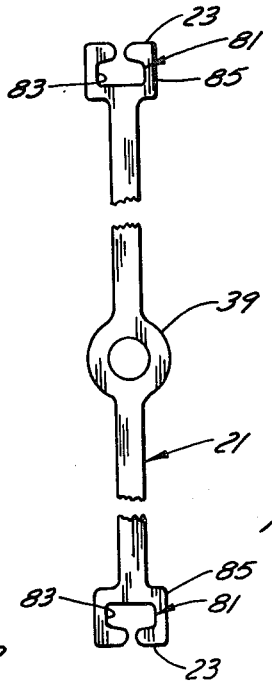
FIG. 5 is an end view of a closure panel.
Figure 6:
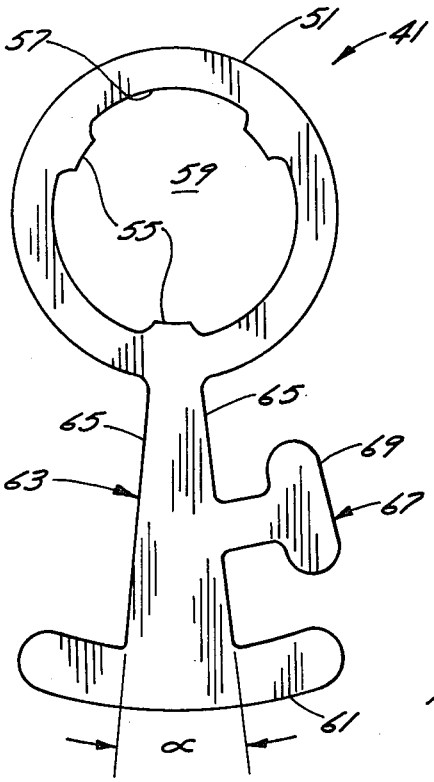
FIG. 6 is an end view of the hinge member.
Figure 7:
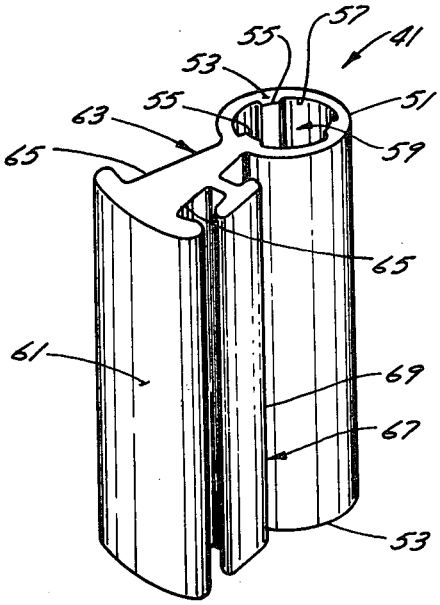
FIG. 7 is a perspective view of one hinge member according to the present invention.

The closure 1 comprises a plurality of rectangular panels 21 pivotably connected together. The panels 21 are arranged serially with the adjacent edges 23 of adjacent panels 21 pivotably connected together by hinge means 25 as will be described. The panels 21 are perferably non-apetured. Each panel 21 has a pivot pin 27 projecting up from the center of its top edge. The upper end 29 of the pin 27 is pivotably attached to a guide member 31 which tracks on wheels 32 in a groove 33 in the bottom of top frame member 7 as shown in FIG. 4. The pin 27 can extend the length of panel 21 if desired as shown in FIG. 1. A nut 35 on pin 27, at the bottom edge 37 of the panel 21, holds the panel on the pin. The pin 27 passes through a vertical, guide bore 39 in the center of the panel 21.

Each hinge means 25 comprises a plurality of identical hinge members 41 arranged serially in a row with their ends abutting. A hinge pin 43 connects the members 41 together. The members 41 pivot about pin 43. Each hinge member 41 has a tubular main body 51 through which the hinge pin 43 passes. The tubular main body 51 preferably is cylindrical and has parallel ends 53. Circumferentially spaced, raised ribs 55 may be provided on the wall 57 defining central opening or bore 59 of cylindrical body 51. The ribs 55 support hinge pin 43 and permit the wall thickness of cylindrical body 51 to be reduced thus saving in material.

The hinge member 41 has a facing wall 61 spaced from tubular body 51 and preferably generally concentric thereto. The width of the wall 61 is somewhat less that the outer diameter of cylindrical body 51 and its length is equal to the length of the tubular body 51.

A web 63 connects wall 61 to cylindrical body 51. The web 63 extends radially from the cylindrical body 51, and connects to the wall 61 at its center. The web 63 preferably is tapered when viewing the hinge member 41 from its ends with the web 63 being wider, where it joins the wall 61, than where it joins the cylindrical body 51. Preferably, the web 63 is tapered to have an included angle $\alpha$, between its side walls 65, of 20°.

Means 67 are provided on one sidewall 65 of web 63 for use in connecting one edge 23 of a panel 21 to the hinge members 41 in hinge means 25. These connecting means 67 preferably comprise a T-shaped rib member 69 projecting laterally out from the center of the one sidewall 65.

When the hinge members 41 are assembled in a row, and threaded by hinge pin 43 to form hinge 25, each second member 41A is inverted so as to place its connecting means 67A on the opposite side of web 63 to the side on which the connecting means 67 is, on every one member 41. Thus, each hinge 25 is provided with a first broken row 71 of connecting means 67 on one side of the aligned members 41 and a second broken row 71A of connecting means 67A on the other side of the aligned members 41.

Each panel 21 has connecting means 81 at each edge 23 cooperating with the connecting means 67 on each hinge 25. The connecting means 81 comprises a T-shaped slot 83 opening inwardly from edge 23. The slot 83 is complementary to, and receives, rib 69 on members 41. An enlarged rib 85 is provided at each edge 23 of panel 21 in which slot 83 is formed. The rib 85 has a width nearly equal to the length of web sides 65.

The closure 1 is assembled by first forming hinges 25 from hinge members 41 and hinge pin 43. Adjacent edges 23 of adjacent panels 21 are then slid onto opposite broken rows 71, 71A of connecting means 67, 67A with the connecting means 67, 67A sliding into slots 83.

Figure 2:
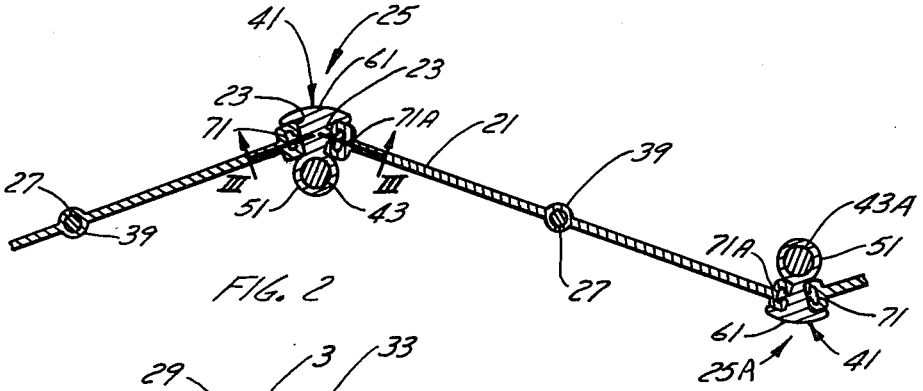
FIG. 2 is a cross sectional view taken along line II—II of FIG. 1.

To permit proper operation of the closure 1, without resorting to other means, the panels 21 must be retained in a zig-zag line when the closure is extended, or folded. It is for this reason that the web 63 of each member 41 is tapered slightly. With the closure fully extended, adjacent panels 21 still cannot become aligned because broken rows 71, 71A of connecting means 67, 67A do not become aligned as shown in FIG. 2.

In order to obtain the zig-zag shape of the closure, it is also necessary to reverse every second hinge 25A so its hinge pin 43A is on the opposite side of the closure to the one side on which hinge pin 43 of every one hinge 25 appears.

It will be noted that the facing walls 61 of each hinge 25 are aligned and form a smooth, unbroken facing 87 on one side of the closure when the closure is fully extended as shown in FIG. 1.

The tubular bodies 51 of each same hinge 25 are aligned and form a smooth unbroken cylinder facing 89 on the other side of the closure.

It will also be noted that facing walls 61 extend laterally past webs 63 and overlap ribs 85 in panels 21 thus eliminating gaps in the hinge when the closure is extended.

I claim:

1. A hinge member comprising an elongated main body, a longitudinal opening in the main body for receiving a hinge pin, an elongated facing wall spaced from the main body, a web extending radially from the main body to the longitudinal center of the wall to connect the wall to the body, and connecting means on one side of the web for use in connecting a panel member to a hinge employing the hinge member.

2. A hinge member as claimed in claim 1 wherein the web tapers slightly in width from a large edge adjacent the facing wall to a smaller edge adjacent the main body.

3. A hinge member as claimed in claim 3 wherein the connecting means comprise a shaped rib extending laterally from the approximate center of the side of the web.

4. A hinge member as claimed in claim 1 wherein the main body is cylindrical in shape, and the facing wall is curved to be concentric with the main body.

5. A hinge comprising a plurality of identical, elongated hinge members arranged end-to-end in a straight row, each hinge member having an elongated main body and a longitudinal opening in the main body, the openings being aligned, and a hinge pin passing through the aligned openings to connect the members together; each member also having an elongated facing wall spaced from the main body, a web extending radially from the main body to the center of the wall to connect the wall to the body, and connecting means on one side of the web for use in connecting a panel member to the hinge.

6. A hinge as claimed in claim 5 wherein the hinge members are arranged in a row to have the connecting means of some of the members in the hinge on one side of the webs, and to have the connecting means of the other members in the hinge on the other side of the webs to provide two broken rows of connecting means.

7. A hinge as claimed in claim 6 wherein the web of each member tapers slightly in width from a large edge adjacent the facing wall to a smaller edge adjacent the main body.

8. A hinge as claimed in claim 7 wherein the connecting means on each member comprises a shaped rib extending laterally from the approximate center of the side of the web.

9. A hinge as claimed in claim 5 wherein the main body of each member is cylindrical in shape, and the facing wall is curved to be concentric with the main body.

* * * * *